US005084306A

United States Patent [19]

McLellan et al.

[11] Patent Number: 5,084,306

[45] Date of Patent: Jan. 28, 1992

[54] PROCESS FOR COATING FABRICS WITH FLUOROCHEMICALS

[75] Inventors: George R. McLellan; Chester C. Wu, both of Pensacola, Fla.

[73] Assignee: Monsanto Company, St. Louis, Mo.

[21] Appl. No.: 601,500

[22] Filed: Oct. 23, 1990

[51] Int. Cl.[5] ..... B05D 3/02

[52] U.S. Cl. ..... 427/339.4; 427/354; 427/434.2; 427/381

[58] Field of Search ..... 427/393.4, 354, 434.2, 427/381, 377

[56] References Cited

U.S. PATENT DOCUMENTS

| | | | |
|---|---|---|---|
| 3,374,107 | 3/1968 | Cotton | 427/377 |
| 3,467,612 | 9/1969 | Gagliardi | 427/393.4 |
| 3,991,236 | 11/1976 | Fleissner | 427/377 |
| 4,397,909 | 8/1983 | Goddard et al. | 427/434.2 |
| 4,507,324 | 3/1985 | Olivé et al. | 427/393.4 |
| 4,592,940 | 6/1986 | Blyth et al. | 427/434.2 |
| 4,668,406 | 5/1987 | Chang | 427/393.4 |
| 4,695,497 | 9/1987 | Nagy, Jr. et al. | 427/393.4 |
| 4,875,901 | 10/1989 | Payet et al. | 8/115.56 |
| 4,937,123 | 6/1990 | Chang et al. | 427/393.4 |

FOREIGN PATENT DOCUMENTS 0102690 8/1987 European Pat. Off. .

*Primary Examiner*—Shrive Beck
*Assistant Examiner*—Diana L. Dudash
*Attorney, Agent, or Firm*—John W. Whisler

[57] ABSTRACT

A process for coating carpets with fluorochemical emulsions is disclosed. The process comprises treating the fabric with a fluorochemical emulsion then heating, rinsing and, finally, drying the treated fabric. The process is characterized in that the emulsion has a pH and divalent metal ion concentration sufficient to effect transfer of the fluorochemical from the emulsion to the carpet during the heating step.

8 Claims, No Drawings

PROCESS FOR COATING FABRICS WITH FLUOROCHEMICALS

BACKGROUND OF THE INVENTION

This invention relates to an improved method for coating carpets and other fabrics with fluorochemicals.

The term "carpet" as used herein means fabric comprising pile fibers attached to a primary backing.

Fluorochemicals are conventionally used in the carpet industry by carpet manufacturers and fiber producers to improve the soil-resistance of their carpets. The fluorochemical when present as a coating on the carpet improves the soil-resistant characteristics (e.g. soil shedding, oil and water repellency) of the carpet. In commercial practice by carpet manufacturers, fluorochemical is typically applied to dyed carpet by passing the carpet in a horizontal direction face up under nozzles which spray a determined amount of aqueous fluorochemical emulsion onto the carpet pile fibers. The carpet is then dried, for example, for 1 to 2 minutes in a 121° C. oven, to remove the water and leave the fluorochemical on the carpet as a coating. Normally, a sufficient amount of the fluorochemical is applied to the carpet so that the coating contains from 200 to 800 ppm fluorine based on the weight carpet fiber (o.w.f.).

This spray method of coating carpets with fluorochemical has the disadvantage that the fluorochemical does not penetrate down into the carpet fabric and therefore does not provide optimum soil protection.

SUMMARY OF THE INVENTION

The present invention provides a simple and economical method for coating carpets with fluorochemical to carpets whereby fluorochemical penetrates down into the carpet and coats a greater portion of the surface of the pile fibers. The method comprises (i) treating the carpet with an emulsion comprising water, fluorochemical particles, an emulsifying agent for said particles, and divalent metal ions and/or acidifying agents, (ii) heating the treated carpet for a period of time sufficient to effect transfer of said fluorochemical from the emulsion onto the carpet, (iii) rinsing the carpet with water to remove excess emulsion components therefrom and (iv) drying the carpet, wherein said emulsion is characterized in that the water phase thereof has a pH and a divalent metal ion concentration such that during said heating at least 60% and, preferably at least 75% and, most preferably, at least 90% of said fluorochemical particles are transferred from the emulsion onto the fabric during said heating of the treated carpet.

The method of the present invention offers several advantages over the above-mentioned prior art method. One advantage is that it coats a greater portion of the pile fiber surface. Another advantage is that it provides a coating that appears to be more securely attached to the surface of the pile fibers. Still another advantage is that the equipment required to carry out the method of the invention is already used in the normal carpet dyeing and/or finishing processes. Also, nozzles used in the prior art method tend to plug with fluorochemical leading to non-uniform application of fluorochemical and interruptions in the process required to clean the nozzles.

DETAILED DESCRIPTION OF THE PREFERRED EMBODIMENTS

The process of the invention is particularly useful for coating carpet with fluorochemicals and may be carried out in a batch or continuous mode.

Emulsions useful for practicing the process of the invention comprise appropriate amounts of water, fluorochemical, emulsifiers for the fluorochemical, and divalent metal ions (added as the water-soluble salt thereof) and/or acidifying agents and can be easily prepared by mixing appropriate amounts of the components together in a conventional manner. The amount of fluorochemical in the emulsion needed to provide a coating on the carpet containing the desired level of fluorine will depend on factors such as the particular fluorochemical being used, the amount of emulsion absorbed (picked up) by the carpet and the amount of fluorochemical transferred from the absorbed emulsion to the carpet during the heating step. The amount of fluorochemical transferred from the absorbed emulsion to the carpet will depend on the pH and on the divalent metal ion concentration of the water phase of the emulsion. In general, the pH of the emulsion is preferably between 2 and 7. At the lower pH's the transfer of fluorochemical onto the carpet is enhanced but corrosion of metal equipment is a problem whereas at higher pH's the corrosion problem is minimized. The pH of the emulsion is adjusted by using acidifying agents with sulfamic acid or sulfuric acid being preferred. At low pH's (e.g. pH of 2) the transfer of some fluorochemicals to carpet can be effective at low divalent metal ion concentrations. On the other hand, at pH's of 7 higher divalent metal ion concentration must be used to effect the transfer of the fluorochemical from the emulsion to the carpet. At pH's in the range of 2 to 7, the amount of divalent ion concentration needed to achieve the desired transfer of the fluorochemical from the emulsion to the carpet can be easily determined by routine experimentation. Preferably, the fluorochemical emulsifiers are ionic in nature, i.e., are cationic or anionic emulsifiers.

According to one embodiment of the invention the process is carried out in the batch mode using carpet beck dyeing equipment. The emulsion is placed in the beck (vat) and the carpet is then circulated in the emulsion by means of rollers over which the carpet passes. The emulsion is then heated. For each emulsion there is a temperature at which the fluorochemical particles therein begin to noticeably transfer from the emulsion onto the carpet. This temperature is generally in the range of 45° to 100° C. and depends on the particular fluorochemical in the emulsion. Usually, the transfer of the fluorochemical onto the carpet takes place within a minute after this temperature is reached. The amount of fluorochemical needed in the emulsion to provide a coating on the carpet having the desired concentration of fluorine can be easily calculated.

According to the preferred embodiment of the invention, the process is carried out in the continuous mode using conventional flex nip roll apparatus to apply the emulsion to carpet. Flex nip roll apparatus has been installed in carpet mills for the purpose of applying stainblockers to carpet immediately after dyeing of the carpet. Briefly, the flex nip roll apparatus comprises two horizontally positioned air-inflatable, air bellows, between which carpet is passed in a vertical direction. Curved stainless steel (ss) sheet members which follow the contour of the bellows are used to house and protect each of bellows. In operation, the air bellows are inflated to provide the desired pressing of the ss sheet members against opposite sides of the carpet. The emulsion is placed in between the ss sheet which in combination with I-beam members form an emulsion reservoir. The desired level of the reservoir is maintained by metering emulsion into the reservoir to replace emulsion absorbed by the carpet as it passes between the ss members. The amount of emulsion absorbed (picked up) by the carpet is determined by its residence time in the reservoir and can further be controlled by removing emulsion from the carpet after it leaves the flex nip roll apparatus, for example, by use of a blade which makes contact with the carpet. The amount of fluorine picked up by the carpet is determined by the amount of emulsion picked up by the carpet and the concentration of fluorochemical in the emulsion. Typically, the flex nip roll apparatus is operated to pick up 300% emulsion based on the weight of the carpet. Under these conditions, the pick up is uniform along the length of the carpet (i.e. three times the dry weight of the carpet and provides a uniform coating of fluorochemical). The carpet, after leaving the flex nip roll apparatus, is passed through a steamer (chamber) containing saturated steam at 100° C. wherein the residence time of the carpet in the steamer is about 1 ½ to 3 minutes. Under these heating conditions, the fluorochemical is transferred from the emulsion to the carpet. After leaving the steamer the carpet is rinsed, then dried by being first subjected to vacuum and then further dried by being passed through an oven. The emulsion may be used at room temperature or heated, if desired, for example, to a temperature of 65° to 70° C.

According to one embodiment of the invention, the carpet pile fibers coated in accordance with the invention are fibers already coated with fluorochemicals previously applied to the fibers during their preparation. For example, the carpet fibers contain from 200 to 600 ppm fluorine o.w.f. applied during their preparation and are coated with an additional 300-500 ppm fluorine o.w.f. in accordance with the present invention.

Instead of immersing the carpet in the emulsion as described above, the emulsion could, for example, be sprayed or padded onto the carpet.

Fluorochemical emulsions containing fluorochemical and ionic emulsifiers thereof useful for carpet applications are commercially available, for example, from Minnesota Mining and Manufacturing, duPont, Imperial Chemical Company, Allied Chemical Company, BASF, Hoechst and others. Such emulsions may be easily modified to provide emulsions useful for practicing the process of the invention. These fluorochemicals emulsions, as supplied, generally contain from 4% to 10% fluorine based on the weight of emulsion (o.w.e.) and have a pH between 5 and 7. Emulsions useful in practicing the process of the invention, must contain the appropriate amount of fluorochemical so that, when carpet is treated in accordance with the process of the invention, it will be coated with the desired (targeted) amount of fluorine. Usually, this amount will range from 200 to 800 ppm fluorine on weight of carpet pile fiber (o.w.f.). As mentioned above, the concentration of fluorochemical in the emulsion required to provide the desired coating will depend on the particular fluorochemical and the percent thereof that will be transferred from the emulsion onto the carpet. In general, the fluorochemical concentration of the commercially available emulsions is too high. Therefore, such emulsion must be diluted with water to obtain the appropriate fluorochemical concentration and, then, appropriate amounts of water-soluble divalent metal salts are added to the emulsion and/or the pH of the emulsion is adjusted to an appropriate value by adding acidifiers to the emulsion.

Water-soluble salts useful for preparing the emulsions include the water-soluble salts of calcium, magnesium, strontium, manganese, iron, zinc, cobalt, nickel, copper and cadmium such as Epsom salt ($Mg\ SO_4.7H_2O$), magnesium nitrate, magnesium acetate, calcium nitrate, and calcium acetate. Emulsifying agents (emulsifiers) useful for preparing the emulsions include any of the commercially available emulsifiers which will keep the fluorochemical sufficiently dispersed in the aqueous phase of the emulsion, that is, provide a stable emulsion. As a practical manner, the final emulsion for use in practicing the invention should be stable for a period of at least 24 hours.

In using flex-nip equipment to carry out the process of the invention, the emulsion, for example, will contain from 100 to 200 ppm fluorine, added as fluorochemical, based on the weight of emulsion (o.w.e.) and the equipment is operated so that the carpet will absorb 300% by weight of emulsion and thereby, assuming 100% transfer of the fluorochemical, the carpet will be coated with 300 to 600 ppm fluorine on weight of carpet.

According to another embodiment of the invention, the emulsion also additionally contains one or more stainblockers (stain-resistant agents). Stainblockers are defined in U.S. Pat. No. 4,680,212, commercially available and widely used in carpet making. Such stainblockers include sulfonated condensation products (e.g. condensation products of dihydroxydiphenyl sulfone, phenol sulfonic acid and formaldehyde), polymethacrylic acid and copolymers thereof, hydrolyzed ethylenically unsaturated aromatic/maleic anhydride polymers, and combination thereof.

In addition to the components described above, the emulsions may also contain other components. For example, carpet mills routinely add a sequestering agent such as EDTA (ethylenediamine tetraacetic acid) to their tap water to tie up (complex) iron ions contained in the tap water which otherwise would cause discoloration (yellowing) of carpet fiber. Accordingly, under such circumstances it may be necessary to add additional water-soluble divalent metal salts to the emulsion to take into account residual sequesting agent.

The following examples are given for purposes of illustration of the invention and are not intended as limitations thereof.

EXAMPLE 1

In this example, experiments are carried out in which carpet samples are coated with fluorochemical in accordance with the process of the present invention using a laboratory method simulating carpet mill flex nip application of fluorochemical emulsion. The divalent metal ion and its concentration and the pH of the emulsion is varied from sample to sample as shown in Table 1 to show the effect thereof on the amount of fluorochemical transferred from the emulsion to the carpet.

The emulsions used in the experiments are prepared by diluting a commercially available fluorochemical emulsion (Hoechst T3555 fluorochemical emulsion containing 7% fluorine o.w.e. and stabilized with an anionic emulsifier) with a sufficient amount of water to reduce the fluorine concentration to 200 ppm o.w.e. The divalent metal ion concentration of the emulsion shown in Table 1 is then obtained by adding an appropriate amount of a 5 to 10% solution of calcium nitrate or magnesium acetate to the Hoechst emulsion. A sufficient amount of E.D.T.A. (ethylenediaminetetraaceticacid) is added to each emulsion to provide 250 ppm thereof o.w.e. The pH of the emulsion is then adjusted using sulfamic acid.

Carpet samples are prepared measuring 10×10 inches (25.4×25.4 cm). The samples have a pile consisting of Suessen heatset, two-ply nylon 66 carpet staple yarn tufted on a 5/32 gauge cut pile tufting machine into a primary backing using 7 stitches per inch (27.6 stitches per cm). The pile height is ⅞ inches (2.2 cm) and 32 ounces of yarn is used per square yard (1.085 kg/m$^2$) of carpet. Each carpet is blank dyed and rinsed with water.

In carrying out the experiments, each carpet sample is wetted with water, centrifuged to remove excess water and then dipped five times into the emulsion. The sample is then squeezed using hand turned squeeze rollers until a 300% pick up of emulsion (600 ppm fluorine) on weight of carpet is achieved. The treated sample is then placed in a preheated 100° C. saturated steam chamber for five minutes. The sample is allowed to cool and then is rinsed with water, centrifuged, and air-dried overnight. Fiber samples (1 to 2 grams) are then taken from the sample and analyzed for ppm fluorine o.w.f. The composition and pH of the emulsion applied to each sample and the results of the fluorine analysis are given in the following table.

TABLE 1

| CARPET SAMPLE | SIMULATED FLEXNIP EMULSION COMPONENT | (ppm) | pH | FLUORINE ON FIBER (ppm) |
|---|---|---|---|---|
| 1 | Fluorine | 200 | 2.5 | 586 |
| | Ca (Ca Nitrate) | 30 | | |
| | E.D.T.A. | 250 | | |
| | Sulfamic Acid | | | |
| 2 | Fluorine | 200 | 2.5 | 731 |
| | Ca (Ca Nitrate) | 600 | | |
| | E.D.T.A. | 250 | | |
| | Sulfamic Acid | | | |
| 3 | Fluorine | 200 | 5.8 | 183 |
| | Ca (Ca Nitrate) | 30 | | |
| | E.D.T.A. | 250 | | |
| 4 | Fluorine | 200 | 6.4 | 630 |
| | Ca (Ca Nitrate) | 600 | | |
| | E.D.T.A. | 250 | | |
| 5 | Fluorine | 200 | 7.5 | 357 |
| | Mg (Mg Acetate) | 360 | | |
| | E.D.T.A. | 250 | | |
| 6 | Fluorine | 200 | 6.3 | 151 |
| | Mg (Mg Acetate) | 18 | | |
| | E.D.T.A. | 250 | | |

The results in The Table show that by selecting an appropriate pH and divalent metal ion concentration combination for the emulsion, excellent transfer of the fluorochemical from the emulsion to the carpet is obtained (samples 1, 2 and 4).

EXAMPLE 2

In this example, experiments are carried out in which carpet is coated with both fluorochemical and stainblocker in accordance with the process of the present invention.

In this instance, each emulsion is prepared by diluting a commercially available fluorochemical emulsion (duPont Zonyl TC-A fluorochemical emulsion containing 5.0% fluorine o.w.e. and stabilized with an anionic emulsifier) with a sufficient amount of water to provide the concentration of fluorine shown in Table 2. Then, a sufficient amount of calcium nitrate solution is added to the emulsion to provide 600 ppm calcium o.w.e. and then a sufficient amount of E.D.T.A. is added to the emulsion to provide 250 ppm thereof o.w.e. Then, 1000 ppm o.w.e. of a commercially available stainblocker (3M FX-369 stainblocker) is added to each emulsion and the pH of the emulsion is adjusted to 2.5 using sulfamic acid.

Carpet samples are prepared and treated with the emulsion, steamed, cooled, rinsed with water, centrifuged and air-dried as described in Example 1.

Fiber samples taken from the air-dried carpets are analyzed for ppm fluorine o.w.f. Five gram samples of fiber are also taken from the air-dried carpet samples, immersed for 7 hours in Cherry Kool Aid solution containing Red Dye No. 40 at a concentration of about 0.054 g/l using a weight ratio of 40:1, Kool Aid to fiber. The solution is made by adding water to commercially purchased packaged ingredients according to the instructions written on the package. After the sample is thoroughly rinsed with water to remove excess Kool Aid and dried, the dye uptake of the sample is then determined by measuring reflectance (K/S) of the sample using a commercially available MacBeth MS 2000 Color Spectrophotometer with 620 manometer wave length filter. The larger the K/S number, the more stained (more Red Dye No. 40 picked up) by the fiber. For purposes of comparison, the stain-resistance of fiber of sample 1 is determined in the manner just described. The results of the experiments are given in Table 2.

TABLE 2

| CARPET SAMPLE | FLEXNIP SOLUTION COMPONENT | (PPM) | pH | CARPET FIBER (ppm) | K/S |
|---|---|---|---|---|---|
| 7 | Fluorine | 200 | 2.5 | 489 | 0.08 |
| | Stainblocker | 1000 | | | |
| | Ca (Ca Nitrate) | 600 | | | |
| | E.D.T.A. | 250 | | | |
| | Sulfamic Acid | | | | |
| 8 | Fluorine | 133 | 2.5 | 433* | 0.19 |
| | Stainblocker | 1000 | | | |
| | Ca (Ca Nitrate) | 600 | | | |
| | E.D.T.A. | 250 | | | |
| | Sulfamic Acid | | | | |
| 9 | Fluorine | 200 | 2.5 | 577 | 0.16 |
| | Stainblocker | 1000 | | | |
| | Ca (Ca Nitrate) | 600 | | | |
| | E.D.T.A. | 250 | | | |
| | Sulfamic Acid | | | | |

*443 ppm represents 280 ppm applied from emulsion. Fiber is precoated with 163 ppm.

The results show that fluorochemical and stainblocker can be effectively and simultaneously applied to carpet using the process of the present invention. For purposes of comparison the K/S value Carpet Sample 1 in Table 1 is 4.3.

EXAMPLE 3

In this example, experiments are carried out in which carpet samples are coated with fluorochemical in accordance with the invention using a laboratory method to simulate beck application of the fluorochemical.

Each of the emulsions used in these experiments is prepared by diluting a commercially available fluorochemical (3M FC-358 fluorochemical emulsion containing 7.2% fluorine o.w.e. and stabilized with a cationic emulsifier) with deionized water to reduce the fluorine concentration to 17 ppm o.w.e. (600 ppm o.w.f.) Then, calcium chloride dihydrate is added to each emulsion in amount sufficient to provide the calcium ion concentrations shown in Table 3. The amount is varied from emulsion to emulsion to show the effect of its concentration on the amount of fluorine transferred to the carpet. Then, sufficient E.D.T.A. is added to the emulsion to provide 250 ppm thereof o.w.e. The pH of the emulsions is 5.7 and is not adjusted in this instance. The resulting emulsions are blue and hazy or opaque in appearance.

In carrying out the experiments, carpet samples prepared, blank dyed, rinsed and dried as described in Example 1 are each placed in a bath consisting of the emulsion using a 35:1 weight ratio of emulsion to carpet fiber. The bath is then heated and the samples are removed from the bath (emulsion) when the appearance of the emulsion changes from hazy blue to clear which change indicates that the fluorochemical has transferred onto the sample. The samples are then rinsed thoroughly with water and oven dried at 150° C. for five minutes. The samples are analyzed for fluorine. The results of the analysis are given in Table III.

TABLE 3

| CARPET SAMPLE | EMULSION COMPONENT | EMULSION (ppm) | FLUORINE ON CARPET (ppm) |
|---|---|---|---|
| 11 | Ca | 1363 | 568 |
| | Fluorine | 17 | |
| 12 | Ca | 681 | 621 |
| | Fluorine | 17 | |
| 13 | Ca | 341 | 419 |
| | Fluorine | 17 | |
| 14 | Ca | 170 | 329 |
| | Fluorine | 17 | |

The results show that by adjusting the divalent metal ion concentration of the emulsion at a given pH substantially all of the fluorine (added as fluorochemical particles) is transferred onto the samples.

Surprising, if the calcium chloride dihydrate is omitted from the emulsions, substantially none of the fluorochemical is transferred onto the samples. It is observed that the rinsing of the samples does not remove any fluorochemical therefrom.

We claim:

1. In a process for coating pile fibers of a carpet with fluorochemical particles wherein an emulsion comprising fluorochemical particles is applied to the carpet and then the carpet is dried to remove water and leave said particles thereon as a coating, the improvement of transferring fluorochemical from said emulsion onto said carpet comprising the preliminary step of adding a water-soluble salt of a divalent metal to said emulsion and the additional steps of heating and rinsing the carpet with water after the emulsion is applied thereto and before the carpet is dried, wherein the pH of said emulsion, the divalent metal ion concentration of said emulsion and the period of time and temperature at which said heating step is carried out are selected whereby a greater percentage of said fluorochemical particles is transferred from said emulsion onto said carpet than if said preliminary step and said heating are omitted.

2. The improvement of claim 1 wherein said pile fibers comprise nylon fibers.

3. The improvement of claim 1 wherein said fluorochemical particles are applied to said carpet by passing the carpet down between the nip of a pair of flex nip rolls, said emulsion being contained in the space between the rolls and above the nip through which the carpet passes in route to said nip and wherein said heating step is accomplished by passing the carpet from said nip through an atmosphere of saturated steam.

4. The process of claim 3 wherein said pile fibers comprise nylon fibers.

5. The improvement of claim 3 wherein the tension of the nip rolls on the carpet is adjusted so that the carpet, as it passes through the nip, absorbs 300% by weight of said emulsion and said emulsion contains from 100 to 200 ppm of fluorine, added as fluorochemical.

6. The improvement of claim 1 wherein said ions are calcium ions.

7. The improvement of claim 1 wherein said ions are magnesium ions.

8. The improvement of claim 1 wherein said emulsion additionally contains a stainblocker.

* * * * *